United States Patent [19]

Hoffman

[11] 4,350,263

[45] Sep. 21, 1982

[54] PACKAGE HAVING SEALED CLOSING MEANS

[75] Inventor: Louis S. Hoffman, Morristown, N.J.

[73] Assignee: H. P. Hood, Inc., Boston, Mass.

[21] Appl. No.: 188,848

[22] Filed: Sep. 19, 1980

[51] Int. Cl.[3] ..... B65D 41/00

[52] U.S. Cl. ..... 220/359; 220/258; 220/307; 229/43

[58] Field of Search ..... 220/256, 258, 306, 307, 220/359; 229/43 R

[56] References Cited

U.S. PATENT DOCUMENTS 3,979,015 9/1976 Arfert ..... 220/307

4,300,700 11/1981 Chang ..... 220/307

FOREIGN PATENT DOCUMENTS 565089 8/1975 Switzerland ..... 229/43 R

*Primary Examiner*—George T. Hall

*Attorney, Agent, or Firm*—Robert T. Gammons

[57] ABSTRACT

A package comprising a container provided at its open top with a flange having portions of concave-convex configurations, a lid provided at the edge with a flange having portions of convex-concave configuration elastically interengaged with the concave-convex portion of the flange at the top of the container so as to mechanically lock the lid to the container and said lid being reinforced by a relatively stiff cover board die-cut to fit into the concave side of the flange at the edge of the lid and wherein portions of the flanges are united by sealing and a method of making the same.

12 Claims, 14 Drawing Figures

PACKAGE HAVING SEALED CLOSING MEANS

BACKGROUND OF INVENTION

Most packages in which food products are sold are provided with lids hermetically sealed in place so as to prolong the shelf life of the package prior to sale; however, after having been sold and opened, the lid is sufficiently damaged and/or distorted so that it cannot be reapplied readily and/or sufficiently securely so as to exclude the ambient atmosphere. Hence, the contents of the package will spoil in a relatively short time. Furthermore, generally the lid is comprised of a relatively thin material so that when placed in storage, it will not support other items on top of it and when such items are placed on top, the lid is deflected downwardly, thus producing gaps which admit the ambient atmosphere into the container. It is a purpose of this invention to provide a container wherein the lid is initially attached by heat-sealing or its equivalent and also with mechanical means which may be disengaged to release the lid when the heat-sealed portion is broken to permit the lid to be removed and thereafter restored after partially using up the contents of the receptacle with a sufficient degree of tightness as to exclude the ambient atmosphere and to provide a lid comprised of relatively thin material with a relatively thick cover board reinforcement which provides means for obtaining an undercut engagement for package resealing without using heavy material for the lid.

SUMMARY OF INVENTION

A package comprising a container and lid, a flange at the top of the container having deviating portions of concave-convex configuration, a flange at the edge of the lid having deviating portions of convex-concave configuration elastically interengaged with the concave-convex portions of the container and a semirigid cover board positioned upon the lid with its edge engaged within the concave side of the convex-concave portions of the flange on the lid. The flange at the top of the container has an outwardly-extending portion defining a horizontal supporting shoulder, an upstanding portion defining a confining shoulder disposed at an angle to the horizontal shoulder and an outwardly-extending lip. The upstanding confining shoulder contains the concave-convex deviations. The flange at the edge of the lid has an outwardly-extending portion defining a horizontal supported shoulder, an upstanding portion defining a confining shoulder disposed at an angle to the horizontal shoulder and an outwardly-extending lip. The upwardly-extending shoulder contains the concave-convex deviations. The lid flange fits into the container flange so that the shoulders and lips coincide and so that the deviating portions of the respective flanges are elastically interengaged. Portions of the horizontal shoulders and portions of the lip are united at their interfaces uninterruptedly peripherally of the container by heat-sealing or its equivalent to provide a seal between the lid and the container.

The package is made by forming the container with an outwardly-extending flange around the top which has a horizontal portion defining a horizontal shoulder, an upstanding portion which defines a shoulder disposed at an angle to the horizontal shoulder and an outwardly-extending horizontal lip and forming in a portion of the upstanding shoulder one or more deviations which are of concave-convex configuration. The lid is formed of a relatively thin sheet material with an outwardly-extending flange at its edge having a horizontal portion defining a horizontal shoulder, an upstanding portion defining a shoulder disposed at an angle to the horizontal shoulder and an outwardly-extending horizontal lip and by forming in the upstanding shoulder one or more deviations which are convex-concave. A cover board of relatively heavy stiff paperboard is die-cut to a size to overlie the lid and to extend into the concave sides of the deviations. The convex portions of the deviations above the cover board hold it in place. The convex-concave portion of the lid reinforced by the edge of the cover board provide in combination a relatively rigid rib for engagement with the concave deviation at the top of the container, thus enabling resealing without using heavy material to form the lid. Optionally, the cover board may be sealed to the lid. The container is filled with the product to be packaged and the lid is applied by pressing the flange at its edge into the flange at the edge of the container so as to elastically interengage the deviating portions and to bring the shoulders and lips into engagement. The horizontal shoulders and the lips are attached at their interfaces to provide a hermetic seal all the way around by heat-sealing or its equivalent.

The invention will now be described in greater detail with reference to the accompanying drawings, wherein.

Figure 2:
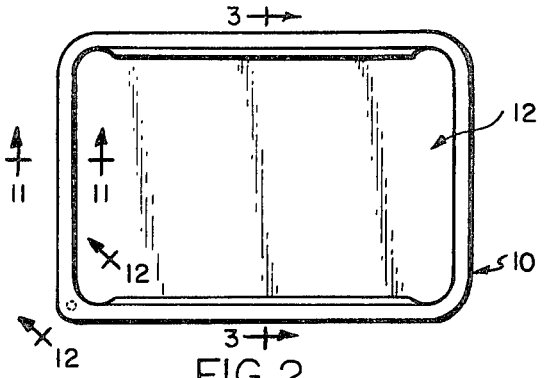
FIG. 2 is a plan view of FIG. 1.
Figure 3:
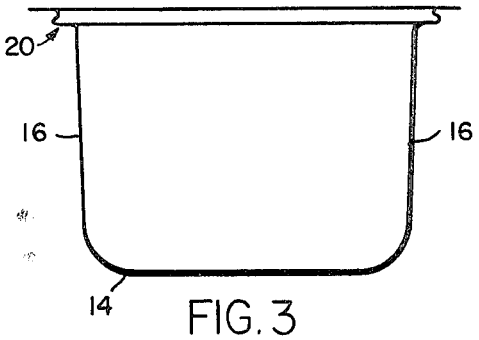
Figure 4:
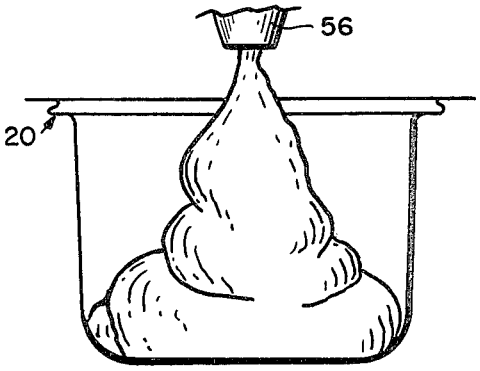
Figure 5:
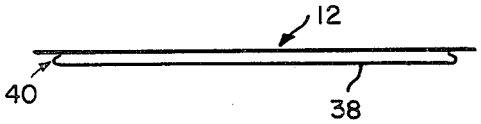
Figure 6:
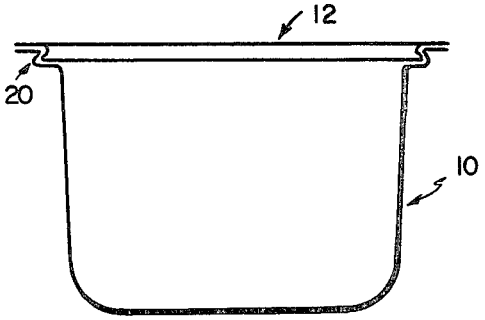
Figure 7:
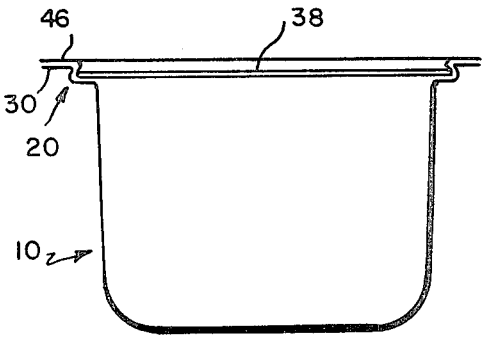
Figure 8:
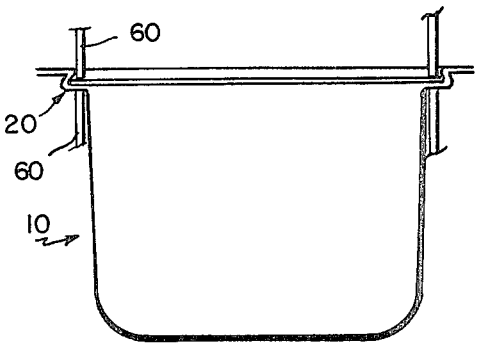
Figure 9:
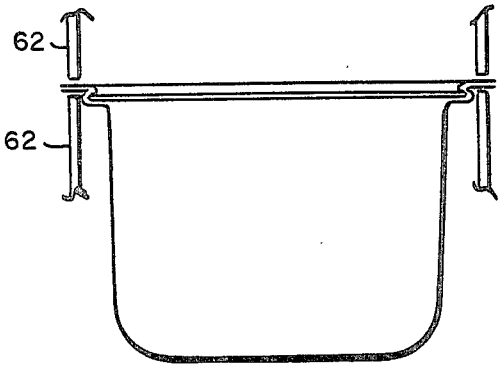
Figure 10:
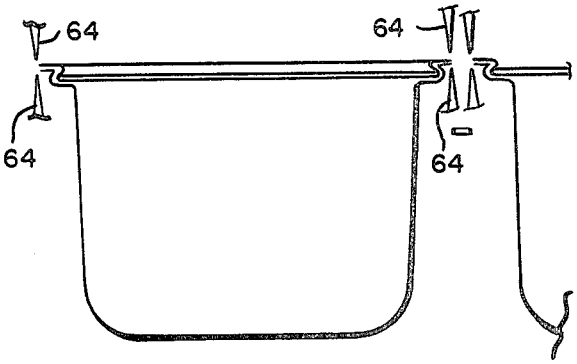
Figure 12:
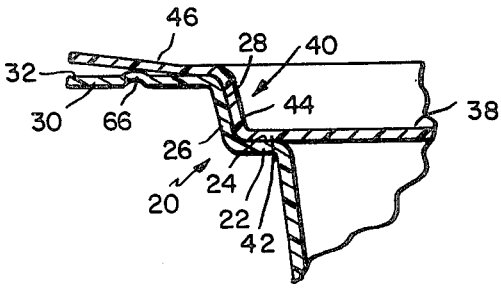
Figure 11:
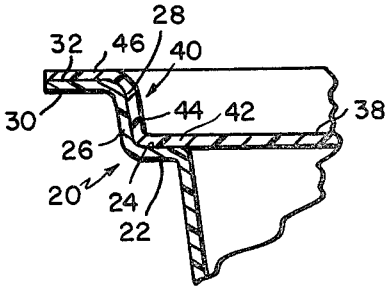
Figure 14:
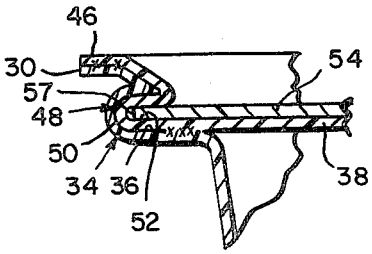
Figure 13:
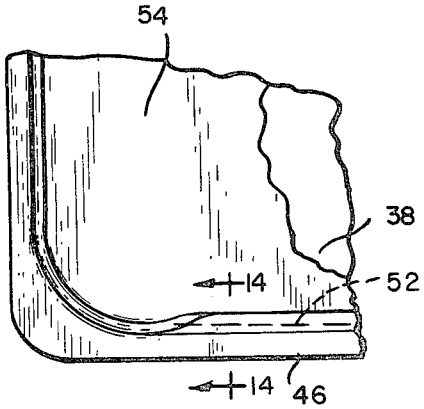

FIGS. 3, 4, 5, 6, 7, 8, 9 and 10 show the several steps taken to make the package wherein FIG. 3 shows the formation of the flange at the top of the container, FIG. 4 shows the filling of the container, FIG. 5 shows the formation of the flange at the edge of the lid, FIG. 6 shows the application of the lid to the container, FIG. 7 shows the application of the cover board to the lid, FIG. 8 shows the formation of a heat seal between the horizontal shoulders, FIG. 9 shows the formation of a heat seal between the horizontal lips and FIG. 10 shows the separation of one completed package from an adjacent completed package;

FIG. 11 is a section taken on the line 11—11 of FIG. 2 with the coverboard omitted;

FIG. 12 is a section taken on the line 12—12 of FIG. 2 with the cover board omitted;

FIG. 13 is a fragmentary plan view of the top of the package showing the interengagement of the deviating portions; and FIG. 14 is a section taken on the line 14—14 showing the interengagement of the deviating portions.

Figure 1:
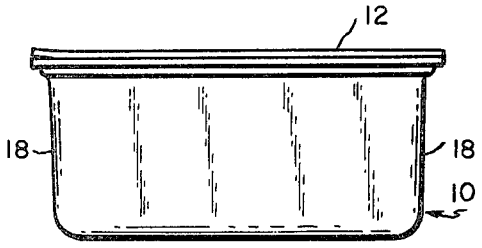
FIG. 1 is an elevation of the completed package.

The package disclosed is designed especially for packaging perishable products such as ice cream in which it is desirable to initially have a hermetic seal between the container and its closing lid and an additional mechanical snap lock fastener type of coupling between the top of the container and the lid so that after the initial seal has been broken and part of the contents have been used up, the lid can be restored to provide a relatively airtight connection between the lid and the container. The package comprises a container 10 and a lid 12, FIGS. 1 and 2. The container 10 is of substantially rectangular, horizontal and vertical section and the lid 12 is of substantially rectangular configuration.

The container 10 is thermoformed of a suitable plastic material with a bottom wall 14, FIG. 3, side walls 16—16 and end walls 18—18. The top of the container is open and has formed thereabout along all four sides a continuous, uninterrupted flange structure 20, FIG. 30. Referring specifically to FIGS. 11 and 12, the flange structure 20 comprises an outwardly-extending, substantially horizontal portion 22 defining a supporting shoulder 24, an upstanding portion 26 defining a retaining shoulder 28 and an outwardly-extending, substantially horizonal lip 30 defining a planar surface 32. Additionally, deviations 34 are formed in the upstanding portions 26 at least along the two opposite longitudinal sides thereof which, as shown in FIG. 14, are outwardly convex and inwardly concave and which define inwardly-facing grooves 36.

The lid 12 comprises a uniformly flat portion 38, FIG. 5, substantially commensurate in area with the open top of the container and has formed along its four edges a continuous, uninterrupted flange 40 which comprises, FIGS. 11 and 12, an outwardly-extending horizontal portion 42 which defines a supported shoulder, an upstanding portion 44 which defines a retained shoulder and an outwardly-extending, substantially horizontal lip 46 defining a planar surface. There is also formed in the upstanding retained shoulder 44 deviating portions 48 as shown in FIG. 14 positioned to coincide with the deviating portions in the flange at the top of the container which are outwardly-convex defining an outwardly-extending rib 50 and an inwardly-facing groove 52. The rib 50 is formed to a dimension to engage within the groove 36 in the flange at the top of the container.

The lid 12 is applied to the open top of the container 10 by forcing the flange 40 at its edge downwardly into the flange 20 about the open top of the container so as to engage the shoulders 42 and 22, 44 and 26 and lips 46 and 30 and to elastically interengage the ribs 50 within the grooves 36.

A semirigid cover board 54 of rectangular configuration is now disposed upon the lid with its edges 57 engaged within the grooves 52. The cover board 54 is made sufficiently rigid to provide support at the top of the container, for example, for stacking of containers and further provides a surface for receiving advertising, identification of the contents and a colorful pictorial display. The lid is thermoformed from a relatively thin sheet material and the cover board is die-cut from relatively stiff paperboard to fit into the groove 52. Thus it is possible to use a relatively thin sheet material for the lid and obtain a snap lock between the convex rib on the lid with the concave groove at the top of the receptacle, the edge of the cover board rigidifying the relatively flexible flange at the top of the lid and supporting it in engagement with the groove at the top of the receptacle whereas, in the absence of the cover board, a relatively thin material could not be successfully used because the flange at the edge of the lid would not be sufficiently rigid to maintain a seal.

The package is sealed at the interfaces of the cover board, lid and container and/or at the interfaces of the lips at the edges of the lid and container.

The package is made by first thermoforming the container 10 as shown in FIG. 3 with the flange structure 20 about its open top, then pouring or depositing the contents to be packaged therein from a nozzle 56, as shown, for example, in FIG. 4. The lid 12 which has previously been thermoformed as shown in FIG. 5 is then engaged with the open top of the container as shown in FIG. 6. The cover board 38 is now inserted into the lid as shown in FIG. 7, whereupon the lid is secured by attaching the shoulder 42 of the lid to the shoulder 22 of the container to provide an uninterrupted, continuous, hermetic seal, for example, by heat sealing as shown in FIG. 8. This may be achieved, for example, by providing high frequency electrodes 60. Following this, the lid and container are additionally secured to provide a secondary, continuous, uninterrupted hermetic seal between the lips 30 and 46, for example, by means of a hermetic seal between the confronting surface of these lips with the aid of electrodes 62.

The packages are made up in multiples and when the lips have been fastened by heat sealing as aforesaid, the completed packages are separated from each other by means of severing elements 64, FIG. 10.

To facilitate removal of the lid, a protrusion 66 is formed at one corner of the lip 30 at the top of the container as shown in FIGS. 12 and 13, so as to hold a portion of the lip 46 away from the lip 30, thus to enable grasping this upwardly-inclined portion to pull it and thus peel the lip 46 away from the lip 30.

The seals provided between the shoulders and the lips, while affording an airtight barrier throughout the period from manufacture to sale and use, can be easily broken to permit the lid to be removed. The interengagement of the deviating portions along the two sides of the receptacle and lid provide mechanical locking means for restoring the lid to its covering position and provide an excellent seal for the package until all of the contents thereof have been used up. While the deviating portions are shown only along two sides, such portions could also be provided along all four sides.

While the seals between the shoulders and ribs as described and illustrated are shown to be formed by heat-sealing, it is within the scope of the invention to attach the lid to the container by means of a thermosetting adhesive or with a pressure-sensitive adhesive.

As previously related, the container and lid are made of thermoformable plastic. Suitable for this purpose are high impact polystyrene, polyethylene, polypropylene and polyvinyl chloride. The cover board is made of paper stock such as cardboard with sufficient strength to bear the weight of stacking and surface finished to be receptive of decorations and printing to denote the manufacturer and content.

It should be understood that the present disclosure is for the purpose of illustration only and includes all modifications or improvements which fall within the scope of the appended claims.

What is claimed is:

1. A package comprising a container and lid, a flange at the open top of the container having portions of concavo/convex configuration along at least two sides of the flange defining a groove, a flange at the edge of the lid having portions of convex/concave configuration along at least two sides of the flange defining a rib elastically engaged with the concave/convex groove at the top of the container, the flanges comprising outwardly horizontal portions defining supporting and supported shoulders, upstanding portions defining containing and contained shoulders and outwardly-extending lips and wherein concave/convex, convex/concave portions are formed in the upstanding shoulders and means associated with the lid for disengaging it from the container.

2. A package according to claim 1 wherein the lip at the edge of the lid is coextensive with the lip at the top of the container and there is means on the lip at the top of the container between it and the lip at the edge of the lid holding a portion of the lip at the edge of the lid away from the lip at the top of the container.

3. A package according to claim 2 wherein the shoulders and lips are coextensive.

4. A package according to claim 3 wherein portions at the interfaces between the supporting and supported shoulders and the lips are heat-sealed.

5. A package according to claim 3 wherein portions at the interfaces between the supporting and supported shoulders and the lips are bonded to each other with thermosetting adhesive.

6. A package according to claim 3 wherein portions at the interfaces between the supporting and supported shoulders and the lips are bonded to each other with pressure-sensitive adhesive.

7. A package according to claim 1 wherein the supported shoulder at the edge of the lid is displaced upwardly from the plane of the lid by at least the thickness of the material of which the lid is comprised.

8. A package according to claim 1 wherein the lid corresponds in area to the open end of the container and the supported shoulder at its edge is connected to the edge of the lid by an upstanding, peripherally-extending flange connected at its proximal edge to the edge of the lid and at its distal edge to the supporting shoulder.

9. A package according to claim 1 wherein the lid is comprised of a relatively thin sheet material and the cover board is comprised of a relatively thick stiff paperboard.

10. A package according to claim 1 wherein the cover board is sealed to the lid.

11. A package according to claim 1 wherein the peripheral edge of the cover board by engagement with the concave groove at the inner side of the flange at the top of the lid rigidifies the flange at the edge of the lid.

12. A package according to claim 1 wherein the peripheral edge of the cover board by engagement with the concave groove at the inner side of the flange at the top of the lid supports the rib at the convex side of the flange in engagement with the concave groove at the inner side of the flange at the top of the receptacle.

* * * * *